US008291738B2

(12) United States Patent
Noe

(10) Patent No.: US 8,291,738 B2
(45) Date of Patent: Oct. 23, 2012

(54) METHOD OF AND APPARATUS FOR LEVELING STRIP

(75) Inventor: Andreas Noe, Kerken (DE)

(73) Assignee: BWG Bergwerk-und Walzwerk-Maschinenbau GmbH, Duisburg (DE)

( * ) Notice: Subject to any disclaimer, the term of this patent is extended or adjusted under 35 U.S.C. 154(b) by 585 days.

(21) Appl. No.: 12/465,739

(22) Filed: May 14, 2009

(65) Prior Publication Data

US 2009/0282883 A1 Nov. 19, 2009

(30) Foreign Application Priority Data

May 16, 2008 (DE) ..... 10 2008 024 013

(51) Int. Cl.
*B21D 1/02* (2006.01)

(52) U.S. Cl. ..... 72/160; 72/205

(58) Field of Classification Search ..... 72/160, 72/161, 162, 163, 164, 165, 205
See application file for complete search history.

(56) References Cited

U.S. PATENT DOCUMENTS

| | | | | | |
|---|---|---|---|---|---|
| 2,140,533 | A * | 12/1938 | MacChesney | 72/160 |
| 2,291,361 | A * | 7/1942 | Walsh | 148/320 |
| 3,238,756 | A * | 3/1966 | Coffin, Jr. | 72/232 |
| 3,270,543 | A * | 9/1966 | Polakowski | 72/162 |
| 3,429,164 | A * | 2/1969 | Oganowski et al. | 72/161 |
| 3,527,078 | A * | 9/1970 | Lawson et al. | 72/160 |
| 3,605,470 | A * | 9/1971 | Polakowski | 72/163 |
| 4,594,872 | A * | 6/1986 | Nordlof | 72/164 |
| 5,097,691 | A * | 3/1992 | Slabowski et al. | 72/165 |
| 5,182,931 | A | 2/1993 | Noe | 72/183 |
| 5,535,610 | A * | 7/1996 | Noe et al. | 72/8.6 |
| 5,829,287 | A | 11/1998 | Noe | 72/8.6 |
| 5,855,132 | A * | 1/1999 | Cozzi | 72/160 |
| 6,240,762 | B1 * | 6/2001 | Kan et al. | 72/161 |
| 6,920,774 | B1 * | 7/2005 | Bergman et al. | 72/160 |
| 6,925,845 | B2 * | 8/2005 | Behrens et al. | 72/161 |
| 7,013,693 | B2 * | 3/2006 | Noe | 72/161 |
| 7,530,250 | B2 * | 5/2009 | Hartung et al. | 72/160 |
| 7,954,351 | B2 * | 6/2011 | Noe | 72/205 |
| 2002/0174699 | A1 | 11/2002 | Noe | |
| 2004/0055350 | A1 * | 3/2004 | Voges | 72/160 |

FOREIGN PATENT DOCUMENTS

EP 1275446 B 1/2003

* cited by examiner

*Primary Examiner* — Dana Ross
*Assistant Examiner* — Homer Boyer
(74) *Attorney, Agent, or Firm* — Andrew Wilford

(57) ABSTRACT

A method of leveling metal strip having a thickness ≦1 mm has the steps of passing the strip in a travel direction through an upstream braking-roller set and a downstream tension-roller set and through a group of leveling rollers between the braking-roller set and the tension-roller set. A predetermined tension equal to at least 70% of a yield limit of the strip is applied to the strip between the braking-roller set and the tension-roller set for stretch-bend or tension straightening by differentially driving the upstream and downstream roller sets. The strip is bent between the leveling rollers to correct longitudinal curve. Leveling rollers are used of diameters that increase downstream in the travel direction and that are so great that the strip follows the curvature of the leveling rollers at the predetermined tension.

9 Claims, 3 Drawing Sheets

METHOD OF AND APPARATUS FOR LEVELING STRIP

FIELD OF THE INVENTION

The present invention relates to a method of and apparatus for leveling strip. More particularly this invention concerns for leveling and straightening steel strip in a steel mill.

BACKGROUND OF THE INVENTION

It is known to level metal strip, in particular thin metal strip having a thickness up to 1 mm, by applying to it a tension of at least 70% of the yield strength being generated in the metal strip between a braking-roller set and a tension-roller set such that the strip is leveled between the braking-roller set and the tension-roller set in a leveling-roller group having multiple leveling rollers. Here, metal strip particularly means a thin metal strip having a thickness of 0.02 mm to 1.0 mm, preferably 0.05 mm to 0.5 mm.

The goal of leveling metal strip is to make the most planar possible strip. One fundamentally differentiates in practice between various types of strip irregularities. In addition to strip waviness and strip cambering, which are to be attributed to length differences over the strip width, band curves frequently occur that are differentiated into longitudinal curve (coil set) and transverse curve (crossbow). The leveling of strips is frequently performed using strip tension, e.g. in tension straightening or in stretch-bend leveling.

Thus tension-stretching apparatuses are known in which a high strip tension is generated between a braking-roller set and a tension-roller set so that eventually the stretching tension necessary for the desired straightening is achieved. In the course of the straightening procedure, the plastic lengthening of the affected strip results in reduction of the strip thickness and strip width. Thus, for example, a method is known for the continuous tension straightening of thin strips, in particular metal strips made of steel, aluminum, or the like having a strip thickness between 0.05 and 0.5 mm, according to which the strip is subjected to the stretching tension necessary for its straightening in the plastic range in a tension straightening roller pair which is interposed between the braking-roller set and the tension-roller set. Using the tension-straightening roller pair, approximately 5% to 25% of the stretching tension for the plastic straightening is generated and, using the braking-roller set and the tension-roller set, 75% to 95% of the stretching tension for the elastic or partially elastic straightening of the strip is generated. The diameter of the tension-straightening rollers is 1500 times greater than the maximum strip thickness (cf. U.S. Pat. No. 5,182,931).

High planarity may be generated using tension straightening in practice and in particular waviness and strip camber may be removed. However, because the strip typically runs off the last tension roller in the plastic range during tension straightening, significant longitudinal curve frequently remains in the strip upon tension straightening that corresponds to the strain roller diameter minus the elastic rebound. The possibility does exist of removing this longitudinal residual curve with lower tension by an adjustable correction roller, for example. However, for thin strips the necessary diameter of the correction roller would be very small in order to still allow partially plastic counter bending. Therefore, it is frequently necessary to support such a stretch-bend leveling roller against sagging in a cassette having support rollers. In high-speed apparatuses, such rollers tend to vibrate and may cause undesired chatter marks on the strip surface. The vibrations may be sufficiently damped by the use of a spray liquid, but then removal of the liquid sprayed in the course of strip cleaning entails increased apparatus and operating costs. Furthermore, the position of the correction roller must be set again for each strip thickness/strip material combination.

Alternatively, strips are frequently leveled in practice in the course of stretch-bend leveling. The strip is bent around a number of leveling rollers having small diameters and lengthened plastically by the degree of stretching by superimposing bending and strip tension, so that waviness is nearly removed. While essentially the degree of stretching is generated on the first leveling rollers, the last leveling rollers are primarily used for curve correction. However, the roller diameter is not assumed on the last leveling rollers, because optimum radii of curvature must be set via the wrap-around angle in each case for different strips. For this reason, at least the last leveling rollers are set differently for different strips. A higher outlay for putting into operation thus frequently results in practice. Moreover, the use of comparatively small roller diameters is again disadvantageous. In addition, because of the bending and the small roller diameters, relatively high residual tensions remain in the strip across its strip thickness, which may be undesirable in the further processing of the strips. For thin strips, a plurality of leveling rollers is also necessary, so that longitudinal residual curves may be removed to the desired extent.

An apparatus for leveling metal strips is known from US 2004/0020258 in which a stretch-bending stand, a correction roller setup, and a multiple-roller leveler are provided between a braking-roller set and a tension-roller set. The multiple-roller leveler has a plurality of working rollers that are supported on support rollers. All working rollers of the stretch-bending stand, the correction roller configuration, and the multiple-roller leveler are rotated by frictional engagement of the strip with the rollers. As a result, they are not driven. The diameters of the working rollers may become greater from roller to roller in the multiple roller unit. However, the diameters are comparatively small, as is typical in multiple roller leveling and/or stretch-bend leveling. In this known apparatus, setting the position of the leveling rollers and thus the depth of engagement as a function of the strip properties is provided.

The known methods (e.g. stretch-bend leveling on the one hand and tension straightening on the other hand) are also combined. Thus, a method of continuous leveling of thin metal strips, which provides tension straightening on the one hand and stretch-bend leveling on the other hand, is known (cf. U.S. Pat. No. 5,829,287).

A method of leveling metal strip in the course of stretch-bend leveling or tension straightening, to which a leveling procedure at low strip tension in a roller leveler is connected downstream, is known from U.S. Pat. No. 6,240,762.

Finally, U.S. Pat. No. 6,925,845 describes a method of and apparatus for the stretch leveling of a metal strip, the metal strip running through a braking-roller set and a tension-roller set and being subjected to a stretching tension between the two roller sets in the course of its straightening and being subjected to bending under tension in a further roller set that is provided between the braking-roller set and the tension-roller set, to increase the stretch rate. The majority of the stretching tension is generated using this further roller set. The tension rollers of the interposed roller set may have a different diameter than the rollers of the braking-roller set and the tension-roller set. The inner tension rollers of this central roller set may have a smaller diameter than the rollers of the braking-roller set and the tension-roller set.

OBJECTS OF THE INVENTION

It is therefore an object of the present invention to provide an improved method of and apparatus for leveling strip.

Another object is the provision of such an improved method of and apparatus for leveling strip that overcomes the above-given disadvantages, in particular that cost-effectively produces strip of low residual tension, high planarity and, in addition, less longitudinal curve.

Another object is to provide a suitable apparatus for performing such a method.

SUMMARY OF THE INVENTION

A method of leveling metal strip having a thickness ≦1 mm has according to the invention the steps of passing the strip in a travel direction through an upstream braking-roller set and a downstream tension-roller set and through a group of leveling rollers between the braking-roller set and the tension-roller set. A predetermined tension equal to at least 70% of a yield limit of the strip is applied to the strip between the braking-roller set and the tension-roller set for stretch-bend or tension straightening by differentially driving the upstream and downstream roller sets. The strip is bent between the leveling rollers to correct longitudinal curve. Leveling rollers are used of diameters that increase downstream in the travel direction and that are so great that the strip follows the curvature of the leveling rollers at the predetermined tension.

The longitudinal curve is preferably corrected in the interposed leveling-roller group by alternate bending of the strip exclusively around leveling rollers of sufficiently large diameter and having sufficiently great wrap-around that the strip assumes the curvature of the rollers. Because the strip follows the curvature of the rollers, a variation of the depth of engagement has no influence on the leveling result. Therefore, according to the invention it is particularly important that the position of the leveling rollers and thus the depth of engagement of a leveling roller between two adjacent leveling rollers of the leveling-roller group be fixed and not changed during the leveling of a strip and/or during the leveling of strips of different thicknesses.

Surprisingly, planar strips having low residual tension and minimal longitudinal residual curves may be generated cost-effectively using the method according to the invention. The risk of chatter marks is avoided without using spray liquids. The fact that a plurality of leveling rollers is provided within a leveling-roller group between the tension-roller set and the braking-roller set is of special significance, these leveling rollers having a comparatively large diameter, so large that the strip follows the curvature of the leveling rollers at the selected strip tension, and without a change of the roller adjustment being necessary as a function of strip thicknesses and strength ranges. With a suitable number of leveling rollers and therefore curve correction rollers having suitable diameters and in particular a suitable diameter gradation, strips having very low longitudinal residual curves may be produced. The selection of the number of the leveling rollers and their diameters and diameter gradation may be performed as a function of a predefined tolerance of the longitudinal curve of $k=1/R=\pm 0.001$, for example. The required number of leveling rollers and the optimum staggering of the preferably successively increasing roller diameters are oriented to the lowest strip thickness at the greatest yield strength.

The leveling-roller group has three leveling rollers, for example, preferably at least four leveling rollers, especially preferably five or more leveling rollers, the diameter increasing from roller to roller within such a leveling-roller group. This has the result that the curve of the strip decreases from roller to roller, so that the longitudinal curve is successively reduced. All leveling rollers preferably have a diameter which is at least 500 times, for example at least 1000 times, the thickness of the strip to be leveled and preferably also the maximum thickness of a strip to be leveled in such an apparatus. The tension between braking-roller set and tension-roller set is preferably set to at least 75%, especially preferably at least 85% of the yield strength. It may be advantageous to set the tension to a value of 90% of the yield strength or more. The tension may be below the yield strength, or also in the range of the yield strength or above the yield strength. In the scope of the invention, yield strength means the yield strength or plastic yield point $R_P$ 0.2, i.e. the tension in the pure tension test at which the plastic elongation is 0.2%. It is therefore within the scope of the invention that leveling of the strip occurs between the braking-roller set and tension-roller set by plastic elongation, e.g. by tension straightening and/or stretch-bending, the curve correction being performed however by alternate bending around the leveling rollers of the leveling-roller group.

The diameter of the leveling rollers of the leveling-roller group preferably increases by a factor of 1.05 to 1.5 from roller to roller, especially preferably by a factor of 1.15 to 1.3. A fixed factor or also a variable factor may be used within a leveling-roller group.

Strips having significantly lesser longitudinal curve is always provided in relation to typical tension straightening. The resulting residual tensions over the strip thickness are significantly less than the residual tensions that can be achieved using stretch-bend leveling.

The number of the leveling rollers and/or curve correction rollers and their diameter gradation are preferably calculated according to a mathematical model that, as the input parameter, considers the strip thickness and/or the strip thickness range, the modulus of elasticity, the transverse contraction index, the tension-elongation curves, the necessary degree of stretching to remove the waviness, the strip tension and/or degree of stretching variations to be expected, the strength variations to be expected within a product, the strip thickness variations to be expected within a product, and/or the absolute value of the maximum permissible longitudinal residual curve. The mathematical model then calculates for various strips, proceeding from a roller configuration, the necessary strip tensions and the resulting longitudinal residual curves. The necessary number of curve correction rollers and the optimum gradation of the roller diameters are directed to the lowest strip thickness at which a specific longitudinal residual curve must still lie within the tolerance. The fact that such a calculation may be performed on the basis of a mathematical model for specific ranges and subsequently in the course of putting into operation and particularly also in the course of operation, no further variation of the parameters and in particular in no further variation of the depth of engagement of the leveling rollers are necessary, is of special significance. Rather, the invention proposes that the position of the leveling rollers and thus the depth of engagement of the leveling rollers between two adjacent leveling rollers is fixedly predefined within the leveling-roller group in the apparatus and is particularly not changed during the leveling, but also upon the change of the strip material and/or the strip thickness. Because of the suitable adaptation of the comparatively large roller diameter, the metal strip assuming the curvature of these rollers, strips over a specific thickness range and thus also strips of different thicknesses may be leveled with outstanding results using a single fixedly mounted configuration. Even if the position of the leveling rollers and thus the depth of engagement is predefined fixed and thus a fixedly mounted configuration is used, in the scope of the invention, this does not preclude the possibility of providing in the apparatus of "opening" the leveling-roller group and thus moving the rollers away from one another in order to be able to thread the strip through the leveling-roller group without bending it, for example, if a connection point between a strip beginning and a strip end (e.g. a weld seam) is to be led through the apparatus. Subsequently, all leveling rollers are then brought back into the fixedly predetermined and/or fixedly mounted configuration, in which the strips are then processed over the desired thickness range without further adaptation.

It is within the scope of the invention that only a single leveling-roller group is provided between braking-roller set and tension-roller set, in which the diameter rises from roller to roller, so that as a result all rollers of the leveling-roller group have different diameters. However, the invention also comprises embodiments in which every two adjacent rollers have an identical roller diameter within such a leveling-roller group having roller diameter which rises overall. In addition, it is within the scope of the invention that one or more additional auxiliary leveling rollers are situated upstream and/or downstream from the leveling-roller group. Thus, for example, it may be advantageous if one or more auxiliary leveling rollers are connected upstream from the leveling-roller group, the diameter of these upstream leveling rollers preferably being less than or equal to the diameter of the first leveling roller of the leveling-roller group. However, a diameter which corresponds to at least 500 times the minimal strip thickness is preferably also selected for these auxiliary leveling rollers. These upstream auxiliary leveling rollers may also be situated between braking-roller set and tension-roller set. However, the invention also comprises embodiments in which strip treatment is performed in multiple treatment zones, e.g. multiple tension-straightening zones, as a result, multiple tension-roller sets being connected one behind another to form multiple treatment zones, e.g. tension-straightening zones. The leveling-roller group according to the invention for removing longitudinal curve is then always situated in the last treatment zone, e.g. the farthest downstream tension-straightening zone. After completed curve correction by the leveling rollers, there is no further plastic deformation, so that the final result of the leveled strip that is additionally free of longitudinal curve, is maintained.

It is within the scope of the invention that all the leveling rollers of the leveling-roller group not be driven. However, the invention also comprises embodiments in which one, several, or all of the leveling rollers of the leveling-roller group are driven, that is rotated by one or more drives. Such a possibility suggests itself, for example, if very large leveling rollers having large moments of inertia are used. In particular, slip when starting the apparatus may be avoided by driving one or more leveling rollers.

The object of the invention is also an apparatus for leveling metal strip, in particular a thin metal strip having a thickness ≦1 mm, according to a method of the described type. Such an apparatus has at least one braking-roller set and one tension-roller set for building up the desired tension and at least one leveling-roller group that is provided between braking-roller set and tension-roller set, having multiple leveling rollers. The diameter of the leveling rollers within the leveling-roller group increases in the strip travel direction from roller to roller. Such a leveling-roller group has at least three rollers, preferably at least four rollers, especially preferably at least five rollers. The diameter of the leveling rollers is at least 500 times the minimal strip thickness and preferably at least 1000 times the minimal strip thickness. The diameter of the leveling-roller group increases from roller to roller by a factor of 1.05 to 1.5, preferably 1.15 to 1.3. In practice, for example, leveling rollers in the leveling-roller group having a diameter of 100 mm to 2000 mm, for example, 200 mm to 1600 mm, preferably 300 mm to 1500 mm may be used.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
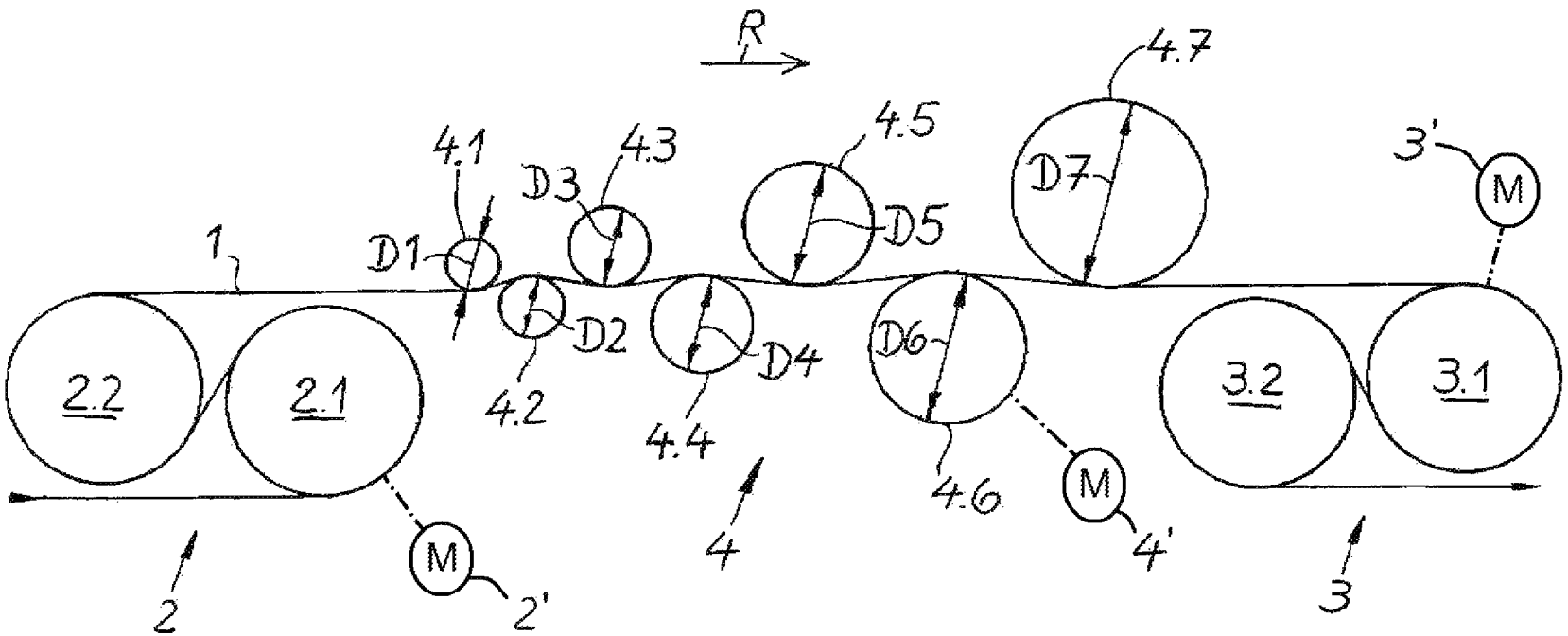
FIG. 1 shows an apparatus according to the invention for leveling metal strip using the method according to the invention.

As seen in FIG. 1 an apparatus for leveling metal strip, in particular a thin metal strip having a thickness d≦1 mm, has a braking-roller set 2 and a tension-roller set 3 in its fundamental construction. In the illustrated embodiment, the braking-roller set 2 only has one roller pair and therefore two braking rollers 2.1 and 2.2, while the tension-roller set 3 also only has one roller pair and therefore two tension rollers 3.1 and 3.2. Of course, the invention also comprises embodiments having roller sets having more rollers, e.g. four rollers or six rollers each. By differentially driving these roller sets (braking-roller set 2 and tension-roller set 3) via respective drives 2' and 3', a strip tension or a tension is generated in the metal strip 1 that is at least 75% of the yield strength, preferably at least 90% of the yield strength.

A leveling-roller group 4 having a plurality of leveling rollers 4.1, 4.2, 4.3, 4.4, 4.5, 4.6, and 4.7 is provided between the braking-roller set 2 and the tension-roller set 3 according to the invention. Longitudinal curve of the strip is removed in this leveling-roller group 4 by alternate bending. The diameters D1-D7 of the rollers of this leveling-roller group 4 are comparatively large, large enough that the strip 1 follows the curvature of all of these leveling rollers within the leveling-roller group 4 at the selected strip tension. Drives such as illustrated at 4' may rotate these rollers 4.1, 4.2, 4.3, 4.4, 4.5, 4.6, and 4.7, FIG. 1 shows that the diameters D1, D2, D3, D4, D5, D6, D7 of the leveling rollers 4.1 through 4.7 of the leveling-roller group 4 increase from roller to roller in the strip travel direction R and thus become greater. In the illustrated embodiment, the leveling-roller group 4 has seven leveling rollers, the roller diameters D1 through D7 increasing from roller to roller by a factor of approximately 1.25. The position of the leveling rollers 4.1 through 4.7 is fixedly predetermined within the apparatus. Setting of the position and/or depth of engagement is not provided in the scope of the invention. Rather, perfect leveling is possible through one-time setting of these parameters, with low residual longitudinal curve for various strip thicknesses, without setting of the depth of engagement of the individual rollers being necessary.

Figure 2:
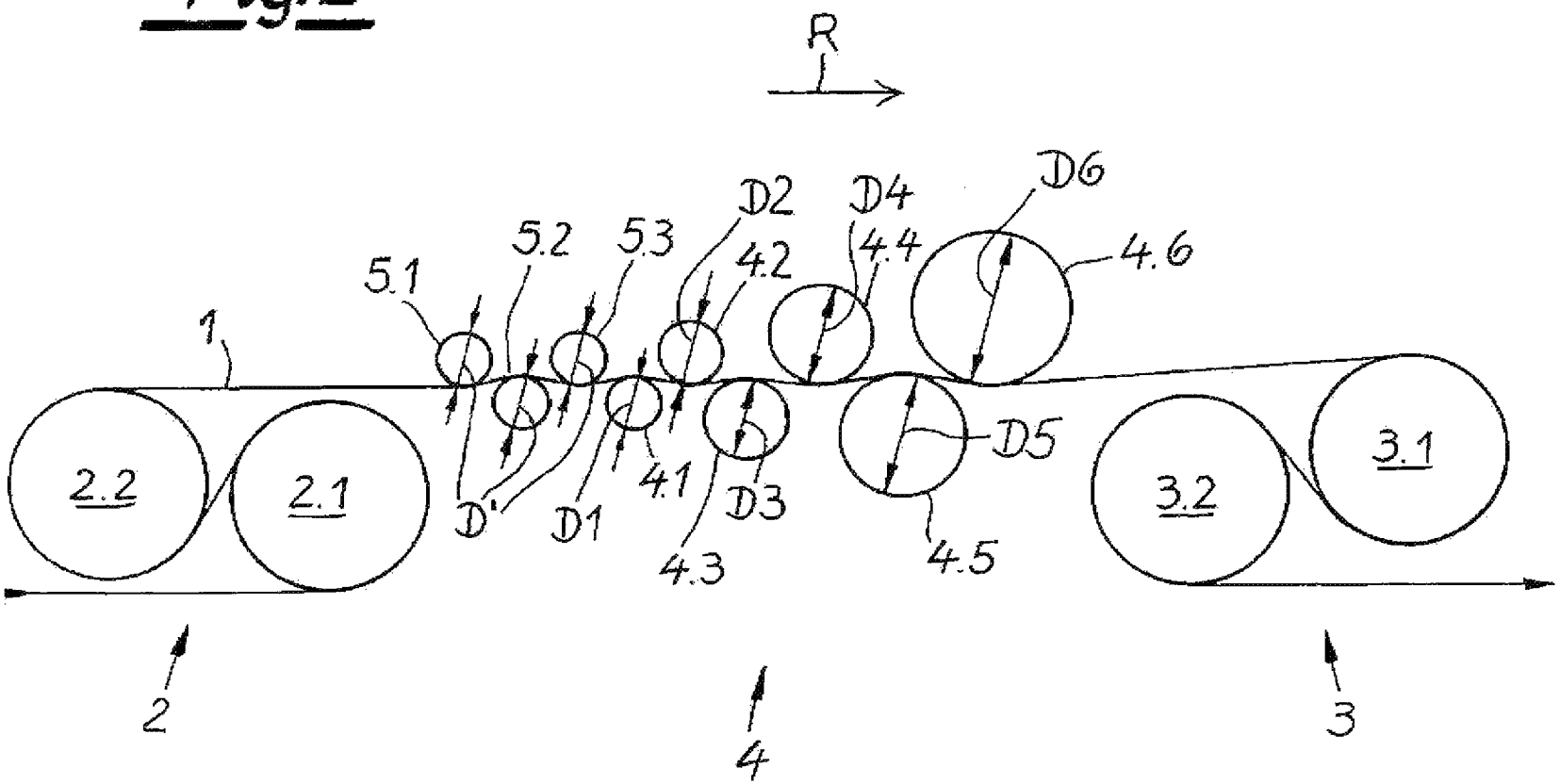
FIG. 2 shows an altered embodiment of the object according to FIG. 1.

While FIG. 1 shows a first embodiment in which only the leveling-roller group 4 is provided between the braking-roller set 2 and the tension-roller set 3, FIG. 2 shows an altered embodiment in which further auxiliary rollers 5.1, 5.2, and 5.3 are situated upstream from the leveling-roller group 4 having the leveling rollers 4.1 through 4.6. The diameters D1 of these additional rollers 5.1 through 5.3 correspond to the diameter D1 of the first leveling roller of the leveling-roller group 4.

Figure 3:
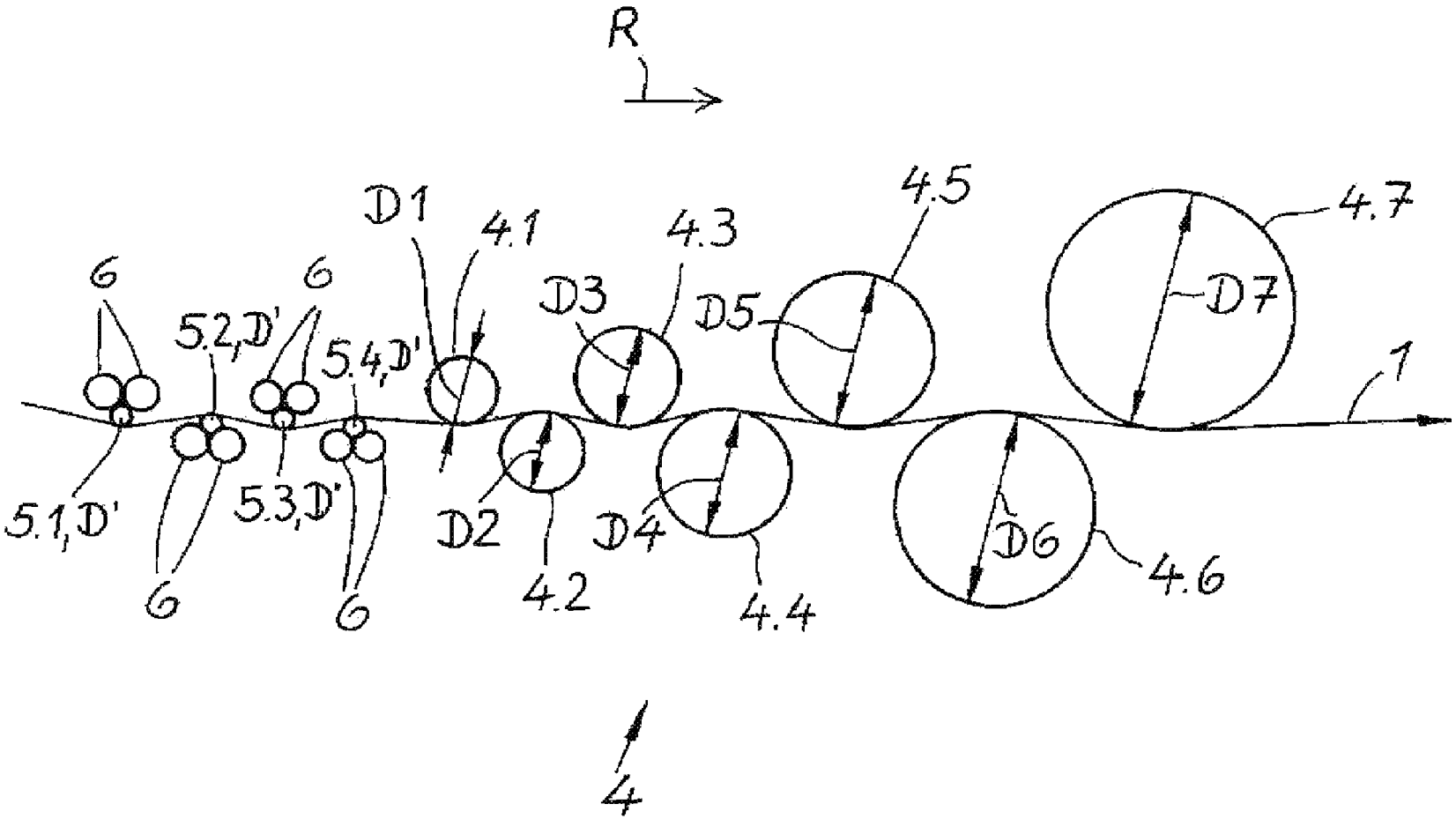
FIG. 3 shows a detail of a further embodiment of the invention.

FIG. 3 shows an embodiment in which four further auxiliary leveling rollers 5.1 through 5.4 are situated upstream from the leveling rollers 4.1 through 4.7 of the leveling-roller group 4. These additional leveling rollers 5.1 through 5.4 have a comparatively small diameter D1 and more or less form stretch-bending rollers. For this reason, each of these leveling rollers 5.1 through 5.4 is supported by support rollers 6. In this embodiment, a stretch-bending roller group 5.1 through 5.4 is now situated upstream from the leveling-roller group according to the invention. Braking-roller set and tension-roller set are not shown in FIG. 3.

The wrap-around angle may be significantly greater in practice than indicated in the figures if necessary. Wrap-around angles of up to 180° or even more are conceivable. The first roller 3.1 of the tension-roller set 3 may thus also be a component of the leveling-roller group 4 and therefore also act on the plastic deformation of the strip by bending

I claim:

1. A method of leveling metal strip having a thickness ≦1 mm, the method comprising the steps of:

passing the strip in a travel direction through an upstream braking-roller set and a downstream tension-roller set and through a group of leveling rollers between the braking-roller set and the tension-roller set, the leveling rollers having a diameter equal to at least 500 times a thickness of the strip;

applying to the strip a predetermined tension equal to at least 70% of a yield limit of the strip between the braking-roller set and the tension-roller set for stretch-bend or tension straightening;

bending the strip between the leveling rollers to correct longitudinal curve;

using leveling rollers of diameters that increase downstream in the travel direction and that are so great that the strip follows the curvature of the leveling rollers at the predetermined tension;

setting a position of the leveling rollers and thus a depth of engagement of a leveling roller between two adjacent leveling rollers of the leveling-roller group, and holding the set depth the same during leveling of a strip and during leveling of strips of different thicknesses.

2. The strip-leveling method defined in claim 1 wherein the predetermined tension is at least 90% of the yield strength.

3. The strip-leveling method defined in claim 1, further comprising the step of:

using at least three such leveling rollers.

4. The strip-leveling method defined in claim 1 wherein the diameters of the leveling rollers increases by a factor of 1.05 to 1.5.

5. The strip-leveling method defined in claim 4 wherein the factor is 1.15 to 1.3.

6. The strip-leveling method defined in claim 1 wherein the strip is between 0.02 mm and 1.0 mm thick.

7. The strip-leveling method defined in claim 1 wherein the strip is between 0.05 mm and 0.5 mm thick.

8. The strip-leveling method defined in claim 1, further comprising the step of:

providing upstream or downstream of the leveling rollers additional leveling rollers of a diameter equal to less than a diameter of the smallest-diameter of the leveling rollers of the leveling-roller group.

9. The strip-leveling method defined in claim 1, further comprising the step of:

driving at least one of the leveling rollers.

* * * * *